United States Patent [19]

MaGill

[11] 4,184,624

[45] Jan. 22, 1980

[54] FLATTENABLE TOP FOR GABLE TOP CONTAINERS

[75] Inventor: Perry W. MaGill, Moraga, Calif.

[73] Assignee: Ampco Foods Inc., San Francisco, Calif.

[21] Appl. No.: 658,734

[22] Filed: Feb. 17, 1976

Related U.S. Application Data

[62] Division of Ser. No. 531,380, Dec. 10, 1974.

[51] Int. Cl.[2] ..... B65D 5/74

[52] U.S. Cl. ..... 229/17 G

[58] Field of Search ..... 229/17 G, 17 R; 53/45

[56] References Cited

U.S. PATENT DOCUMENTS

| | | | |
|---|---|---|---|
| B 461,257 | 1/1976 | Zarsson | 229/17R |
| 2,070,838 | 2/1937 | Örström | 53/45 |
| 2,416,332 | 2/1947 | Lehman | 229/17 G |
| 2,457,822 | 1/1949 | Jones | 229/17 G |
| 3,185,376 | 5/1965 | Crawford et al. | 229/17 G |
| 3,389,849 | 6/1968 | Egleston | 229/17 G |
| 3,549,080 | 12/1970 | Gill | 229/17 R |
| 3,869,078 | 3/1975 | Braun | 229/17 R |
| 4,012,997 | 3/1977 | Bachmer et al. | 93/36.8 |
| 4,085,885 | 4/1977 | Lisiecki et al. | 229/17 R |
| 4,093,115 | 2/1977 | Bachmer et al. | 229/17 G |

*Primary Examiner*—Davis T. Moorhead

*Attorney, Agent, or Firm*—Thomas H. Olson

[57] ABSTRACT

An apparatus and method for folding the gable top of gable top containers into a flat condition preparatory to packing a plurality of such containers into a carton so as to avoid wasted volume during transport of such containers. A gable top container having an extra score line to facilitate such folding of the gable top.

3 Claims, 5 Drawing Figures

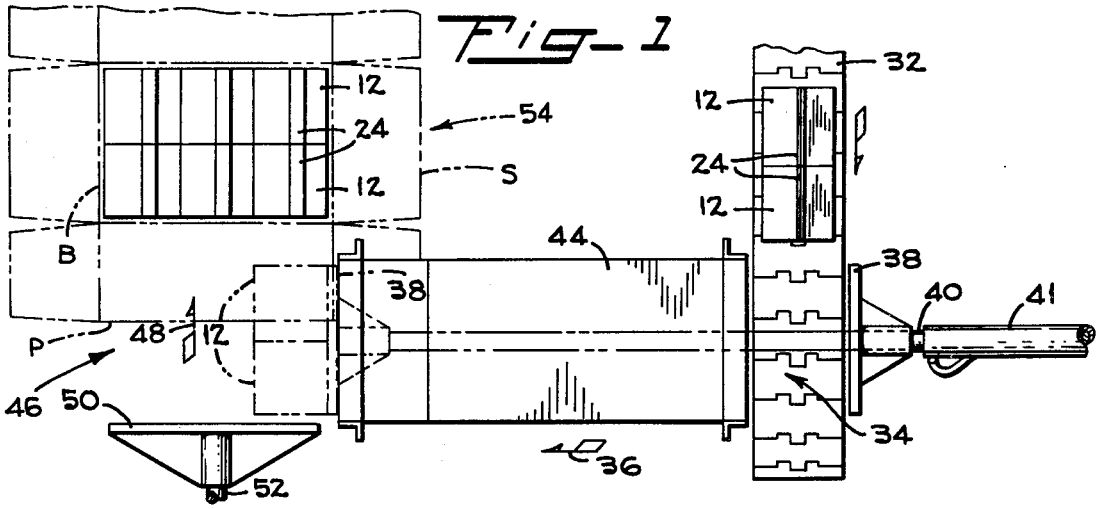
Fig_1
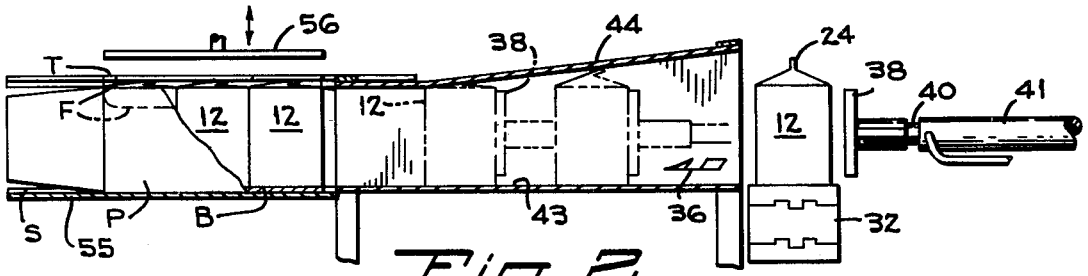
Fig_2
Fig_3
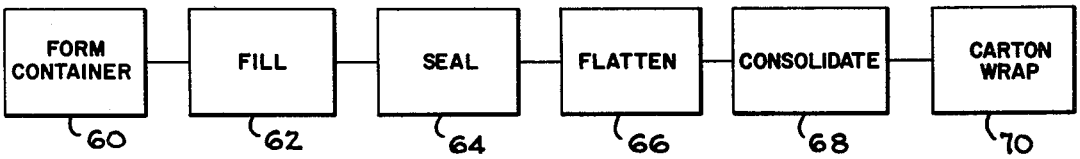
Fig_4
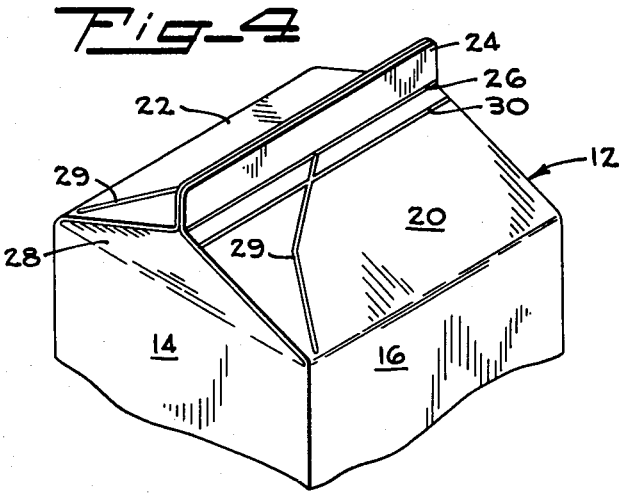
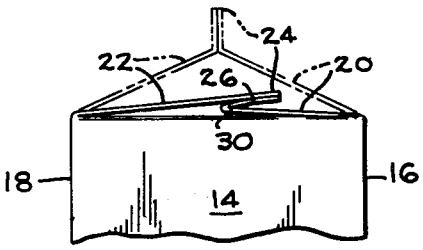
Fig_5

FLATTENABLE TOP FOR GABLE TOP CONTAINERS

This is a division of application Ser. No. 531,380 filed Dec. 10, 1974.

BACKGROUND OF THE INVENTION

1. Field of the Invention

This invention relates to gable top container for food products and the like, and more particularly to an improved container structure and the method and apparatus for flattening the gable top preparatory to packing a plurality of such containers in a carton so as to reduce shipping volume without adversely affecting the utility of the container by the consumer.

2. Description of the Prior Art

U.S. Pat. Nos. Re. 26,305 and 2,389,849 (229-17) disclose gable top containers of the type widely employed for food products. Although the gable top configuration of the containers affords sufficient sealing and opening at the time of consumption of the contents, the gable top occupies substantial volume when plurality of the containers are transported.

SUMMARY OF THE INVENTION

The volume enclosed by the gable top portion of the container ordinarily does not contain the food product since the food product level is below the gable top. According to the present invention the gable top is folded down to a substantially flat condition and a plurality of such containers are placed in a carton which holds the tops in such flat condition. When the carton is opened, the force on the gable top is released and the gable top partially springs to an upright position. It can be readily moved to a full upright position so as to permit opening of the top in the manner disclosed in the above cited patents.

An object of the present invention is to provide a method for packing a plurality of gable top containers so that the volume of the plurality of containers is substantially less than has existed in the known prior art. This object is achieved by flattening the gable top after the container is filled and sealed and by placing a plurality of such containers in a carton which maintains the top in the flat condition.

Another object of this invention is to provide an improved gable top container which can be folded into a flat condition in a neat and efficient way. This object is achieved according to the present invention by providing on at least one of the upwardly sloping panels which forms part of the gable top an extra score line so that the panel can be concavely folded at the score line to achieve the advantages referred to above.

A further object of the invention is to utilize apparatus for moving filled and sealed gable top containers toward cartoning equipment to apply a force to move the gable top to a folded, flattened condition. This object is accomplished according to the present invention by providing a tunnel-like structure that has an upper smooth surface which converges in the direction of container movement so that forward movement of the containers through the tunnel compresses and folds the gable top into the flat condition. From the tunnel-like structure a plurality of the containers are consolidated and transported to conventional cartoning apparatus.

The foregoing together with other objects, features and advantages will be more apparent after referring to the following specification and accompanying drawings.

BRIEF DESCRIPTION OF THE DRAWINGS

FIG. 1 is a plan view of a container conveying line according to the present invention which automatically compresses and folds the gable top container structure.

FIG. 2 is an elevation view of the apparatus of FIG. 1.

FIG. 3 is a block diagram showing the steps in filling and cartoning gable top containers according to the method of the present invention.

FIG. 4 is a fragmentary perspective view of a gable top container embodying the present invention.

FIG. 5 is a side view of a gable top container of FIG. 4 showing the top structure in a partially folded condition.

DESCRIPTION OF THE PREFERRED EMBODIMENT

The disclosures of U.S. Pat. Nos. Re. 26,305 and 3,389,849 are incorporated hereinto by this reference for their disclosures of gable top cartons and the procedure for constructing and filling the same.

Referring more particularly to the drawings, and specifically to FIGS. 4 and 5, reference numeral 12 indicates a gable top container constructed according to the above referenced U.S. Patents and including the present invention. As disclosed in the cited patents the container includes four approximately congruent rectangular side panels, three of which are seen at 14, 16 and 18, there being a panel substantially identical to panel 14 which is not seen in the drawing. Integral with and converging upward from the top edges of panels 16 and 18 are respective sloped gable panels 20 and 22, the upper edge margins of which are sealed in a vertically extending rib 24. As disclosed in the above cited patents, there are score lines between gable panels 20 and 22 and rib 24, one such score line being identified at 26 in FIG. 4. Also sealed within rib 24 are upward projections of side web portions 28 which cooperate to enclose fully the container and seal the contents thereof. Panels 20 and 22 include oblique score lines 29 which facilitate opening the container and forming a pouring spout.

According to the present invention there is a score line 30 formed in gable panel 20. Score line 30 is parallel to score line 26 and is spaced therefrom by a distance such that panel 20 can be concavely folded at the score line to a substantially flat condition as shown in solid lines in FIG. 5. More particularly, score line 30 is spaced from score line 26 by an amount such that the container can be folded flat without substantially distorting gable panel 22. If the slant length of gable panel 22 from the upper edge of side panel 18 to rib 26 is considered equal to A and the horizontal extent of the side panel 14 (i.e. the span of the gable top) is considered B, then the distance X from score line 26 to score line 30 is $X=A-B/2$. In one container designed according to the present invention, A is equal to about 3 inches, B is equal to about $5\frac{3}{8}$ inches and X is equal to about 5/16 inches. Thus, when force is applied in a horizontal direction in a rightward direction as viewed in FIG. 5, panel 20 is concavely folded at score line 30 so that the gable top of container 12 can assume a smooth, flat position without distorting panel 22. The invention provides apparatus for efficiently applying such force with little or no interference with existing container handling equipment.

Referring to FIG. 1, reference numeral 32 identifies the output conveyor of conventional container forming and filling equipment which per se forms no part of the present invention and is well known in the art. Prior to completing traverse of conveyor 32, the container blank is folded, adhesively secured into a container shape, and filled with product up to a level at or below the upper extremity of side panels 14–18. The containers are transported on conveyor 32 to a transfer station 34. When the containers arrive at station 34 they are oriented so that rib 24 of the containers extends in a direction transverse to the path of subsequent movement of the containers, such direction of movement being indicated by an arrow 36. Containers 12 reach station 34 in pairs and are moved laterally from conveyor 32 toward the left as viewed in FIGS. 1 and 2, by a push plate 38 which is connected to a drive rod 40. Drive rod 40 is reciprocated by any suitable actuator, such as a pneumatic or hydraulic cylinder 41, to move the paired containers through a tunnel 42. Tunnel 42 is formed on the bottom thereof (see FIG. 2) by a conveyor surface 43, which is at about the same level as conveyor 32 at station 34. Tunnel 42 has at the top thereof a plate 44, which converges toward surface 43 in the direction of arrow 36. At the inlet end of the tunnel, i.e. to the right hand extremity as viewed in FIG. 2, the vertical distance between surface 43 and converging plate 44 exceeds the vertical dimension of the container, i.e. the overall distance from the bottom of the container 12 to the topmost extremity of rib 24 when it is in the full vertical or upright position as seen in FIG. 4. At the outlet end of the tunnel, i.e. to the left as viewed in FIG. 2, the vertical distance between converging plate 44 and surface 43 is only slightly in excess of the vertical dimension of the side container panels 14–18. In one apparatus designed according to the present invention tunnel 42 has a length of about 2 feet, a height at the inlet end of about 10 inches and a height at the outlet end of about 7¾.

As push plate 38 moves paired containers 12 through tunnel 42, there is a rightward and downward force applied first on rib 24 and then on panel 22, which folds the rib over in a clockwise direction as viewed in FIG. 2 and concavely deforms gable panel 20 at score line 30. The deformation occurs along the score line until the gable top assumes a folded position somewhat beyond that shown in FIG. 5.

When the paired containers exit tunnel 42, the force applied on the gable top by converging plate 44 is released, and the gable top can partially move upward from the full flattened condition, which occurs because the containers are constructed of such material as relatively stiff paperboard sheetcoated on each side with a layer of polyethylene or the like. However, traverse of the containers through tunnel 42 deforms panel 20 to a degree that the gable top does not resume a full upright position.

In one system embodying the present invention, three rows, each of which contains two containers 12, are accumulated or consolidated on a station 46 at the outlet end of tunnel 42. When the prescribed number of containers are consolidated at station 46, they are moved laterally along a path indicated by arrow 48 in FIG. 1 by a push plate 50. Push plate 50 is reciprocated by a drive rod 52 which is actuated by a suitable actuator (not shown) to deliver the group of containers to a cartoning station 54. In one system designed according to the present invention, a conventional cartoner known in the trade as a Salwasser Model W15 cartoner is employed as a wrapping means. The cartoner, which per se forms no part of the invention, supports a heavy paper or cardboard carton blank on a platform 55; the grouped containers are transported onto the blank on the platform by push plate 50. The cartoner apparatus automatically folds a carton blank to form a bottom panel B, a side panel S, a front panel P, and finally a top panel T. The carton blank is shown in a flat condition by broken lines in FIG. 1 and in a partially completed condition by solid lines in FIG. 2. As can be seen in FIG. 2, top panel T is folded onto the gable tops of containers 12 so that a flattening force is applied, such force acting to retain the gable top in the same flattened condition as is achieved as the containers move through tunnel 42. Accordingly, even though the gable portions of containers 12 spring up partially from the flat condition as they exit from the tunnel, the mode of operation of the cartoner is such that the gable tops are compressed down to a flat condition.

The cartoner includes a vertically reciprocating platten 56 which holds top panel T and the gable portions of the containers in a flat condition while adhesive or the like is applied to a flap F of the carton. The sealed position of flap F is shown fragmentarily by a broken line in FIG. 2. Thereafter the carton side panels are folded and glued into place in a conventional manner (not shown) and the carton is ready for shipment. Because the wasted volume occupied by the upright gable portions is eliminated, the overall volume of the carton is less even though the volume of the contents is the same as has heretofore been the case.

When the carton reaches its destination it is opened by conventional techniques, whereupon the gable tops can partially move to an upright condition and can be manually straightened if such is desired. Accordingly the procedures for opening the containers, as disclosed in the above cited patents, can proceed without interference due to practice of the present invention.

With reference to FIG. 3, the method of the present invention is incorporated in the container forming, filling and packing procedure as disclosed in block diagram form. The block at 60 represents the formation of a container by folding and gluing a blank in accordance with conventional procedures. Next the container is filled, such step being identified at 62 after which the container top is sealed at 64 to form rib 24. Thereafter the container is transported through tunnel 42 to flatten the gable top, such step being indicated in FIG. 3 at 66. At the outlet end of tunnel 42 a plurality of the containers are accumulated or consolidated with all deformed gable tops deformed in the same direction, rightward as seen in FIG. 2. The consolidating step is indicated in FIG. 3 at 68. Finally the group of containers is moved to cartoning station 54 where the carton is formed around the consolidated containers, the cartoning step being indicated in FIG. 3 at 70. In performing the cartoning step the top panel of the carton is moved downward, e.g. by platten 56, onto the deformed gable tops so as to impart to the partially deformed gable tops a force that is directed so as to move the partially folded gable tops to the full flat condition. Included in the cartoning step is sealing the carton flap F so that the top panel T of the carton retains the containers in a flat condition.

Thus it will be seen that the present invention provides for reduction of the volume of shipment for gable top containers with minimal disruption of the normal processing line of container filling and cartoning equipment. In the exemplary container referred to hereinabove, the shipping volume, for a given quantity of food product, is reduced by more than 20%. In addition to volume reduction, cartons of flattened containers afford superior vertical stacking strength so that more cartons can be stacked in a given warehouse floor area than has been practicable heretofore. Although it is preferred to form the extra score line 30 in panel 20 of the container so as to assure a smooth flat fold after traverse of tunnel 42, the formation of the extra score 30 is not absolutely essential since the gable portion will be folded flat on traverse of the tunnel even without the score line. The invention finds application, irrespective of the size of the containers or the particular form of food product placed in the containers, to reduce the shipping volume of the containers. Although one embodiment has been shown and described it will be obvious that other adaptations and modifications can be made without departing from the true spirit and scope of the invention.

What is claimed is:

1. A blank for a gable top carton of the type that has first and second substantially identical upward converging slanting gable panels at the upper region of which are respective upper score lines for affording sealing of the carton top to form a rib and wherein said gable panels have a slant length A and the carton top has a span B which is less than twice A, the improvement comprising said first gable panel defining an auxiliary score line parallel with and below said upper score line so that said first gable panel can be concavely folded at said auxiliary score line to flatten said gable top without substantially distorting said second panel.

2. In an article of manufacture including a gable top container of the type having first and second substantially identical upward slanting rectangular gable panels which are sealingly joined together at an upstanding rib and wherein the gable panels have substantially identical slant lengths so that the rib is symmetrical of the container and normally disposed thereabove, the improvement comprising a score line formed in at least a first one of said gable panels parallel to the rib and spaced therefrom by an amount so that said first gable panel can be concavely folded at said score line so that the gable top panels can be moved to a smooth flattened condition, said panels and said rib being disposed so as to afford erection of said gable top preparatory to opening the container.

3. An improved blank according to claim 1 wherein said auxiliary score line is spaced below said upper score line by a distance substantially equal to $A-B/2$.

* * * * *